US006276566B1

(12) United States Patent
Zaksenberg

(10) Patent No.: US 6,276,566 B1
(45) Date of Patent: Aug. 21, 2001

(54) ENHANCED THREE-DIMENSIONAL CONTAINER DISPLAY

(75) Inventor: Issac Zaksenberg, Scotch Plains, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/410,936

(22) Filed: Oct. 5, 1999

(51) Int. Cl.[7] ..... B67D 5/40
(52) U.S. Cl. ..... 222/78
(58) Field of Search ..... 222/78

(56) References Cited

U.S. PATENT DOCUMENTS

| | | | | |
|---|---|---|---|---|
| D. 243,817 | | 3/1977 | Cloyd . | |
| D. 294,671 | | 3/1988 | Koziol . | |
| D. 318,794 | | 8/1991 | Litton et al. . | |
| 4,733,785 | | 3/1988 | Turner, Jr. et al. . | |
| 5,071,379 | | 12/1991 | Poizot . | |
| 5,226,538 | | 7/1993 | Roselle . | |
| 5,887,763 | | 3/1999 | Foster . | |
| 5,915,600 | | 6/1999 | Bitton . | |
| 5,937,554 | | 8/1999 | Haugk . | |
| 6,006,958 | * | 5/2000 | Bitton | 222/78 |
| 6,065,640 | * | 5/2000 | Ho et al. | 222/78 |
| 6,073,373 | | 6/2000 | Haugk et al. . | |
| 6,119,897 | * | 9/2000 | Boileau | 222/78 |

FOREIGN PATENT DOCUMENTS

| | | |
|---|---|---|
| WO/94/29838 | 12/1994 | (WO) . |
| WO/98/47810 | 10/1998 | (WO) . |

* cited by examiner

*Primary Examiner*—Philippe Derakshani
(74) *Attorney, Agent, or Firm*—Michael J. McGreal

(57) ABSTRACT

The three-dimensional design of a container is enhanced by the suspension of a three-dimensional design within the container. This is accomplished by a depending member which is a part of a container closure or which is supported by the upper edge of a container and held in place by a closure. This depending member has a three-dimensional design attached thereto or as an integral part thereof. The depending member can be cylindrical of different shapes or can be discontinuous such as having a longitudinal gap extending partially or fully the length of the depending member. When the closure to the container is a pump dispenser the dip tube of the pump dispenser can pass through and be partially or fully surrounded by the depending member, or optionally the dip tube can be the depending member with the three-dimensional design attached thereto or an integral part thereof. In a further embodiment the liquid in the container and the material of the depending member, and optionally a dip tube, have refractive indices whereby the depending member and dip tube substantially visually disappear in the liquid of the container. The result of the foregoing embodiments is a container that has a striking three-dimensional design appearance.

34 Claims, 4 Drawing Sheets

ENHANCED THREE-DIMENSIONAL CONTAINER DISPLAY

FIELD OF THE INVENTION

This invention relates to a container that has one or more complementary designs on the container and a three-dimensional item that, in turn, is complementary to the complementary designs. More particularly, this invention relates to a container with a depending member, one or more complementary designs on and within the container, a three-dimensional item attached to or an integral part of the depending member and coordinated with the other designs on and/or within the container.

BACKGROUND OF THE INVENTION

There is a continuing need to decorate containers to make them more attractive. This particularly is the case where the container is available for others to see and use. Containers of this type are used for dispensing many products such as hand soaps that usually are left out on a sink top area. These containers are decorated by a decorative label on the front and/or rear surfaces. This was improved by the additional use of a coordinated design on a film inserted within the container. This latter concept is the subject of U.S. Pat. No. 5,937,554. However, these decorative containers of the prior art can be improved upon. Such an improvement in container decoration is set out in this application for patent.

The problem that has been presented is how to efficiently mount a three-dimensional design in a container. This can be a container where the contained product is poured from the container or is dispensed from the container by means of a pump dispenser or some other device. This problem is solved by the use of a depending member that has the three-dimensional design decoration attached at a lower part of the member, or which has the three-dimensional design decoration as an integral part of the depending member. The depending member can be a part of the container closure or can be a unit that is supported by an upper ledge of the container and held in place by the closure. If the container is one that has a pump dispenser, the dip tube can be fully or partially surrounded by the depending member or the dip tube can comprise the depending member. In any event, a three-dimensional design, such as an object, can be effectively disposed in a container with this three-dimensional design coordinated with a design on a front and/or rear surface of the container. This enhances the three-dimensional effect of the designs on the container and the object or other three-dimensional design within the container.

The relevant prior art is set out in U.S. Pat. No. 4,733,785 and U.S. Design Pat. Nos. 240,789; 243,817 and 318,794. U.S. Pat. No 4,733,785 discloses a buoyant chamber with advertising material attached to a straw in a container. U.S. Design Pat. Nos. 240,789 and 243,817 disclose objects attached to drinking straws. U.S. Design Pat. No. 318,794 discloses a decorative spiral attached to the pump body of a pump that is a part of a container. However, none of these references discloses a three-dimensional design attached to a depending member of a container, and none disclose such a three-dimensional design also coordinated with designs on the front and/or rear surfaces of the container. Through the use of a three-dimensional design attached to a depending member, and this three-dimensional design coordinated design-wise with designs on one or more of the front and rear surfaces of the container, there is an enhancement of the three-dimensional effect and a container with improved decoration.

The present invention solves the problem of how to increase the three-dimensional decoration of containers. The three-dimensional effect is more pronounced when a three-dimensional design, such as an object, is made a part of the overall decoration. It also solves the problem of how to effectively secure the three-dimensional member in a container.

BRIEF SUMMARY OF THE INVENTION

The present invention is directed to product containers that have an improved decorative appearance. It is known to put decorative labels onto containers to enhance the appearance of the container. Also, it is known to suspend articles within a container to enhance the appearance of a container. In the present invention the appearance of a container is enhanced by effectively securing three-dimensional designs, such as objects, within the container. These three-dimensional designs are of a type to coordinate with the labels on the front and/or rear surfaces of the container to provide a striking three-dimensional effect.

The three-dimensional designs are suspended within the container by being attached to a depending member or being an integral part of the depending member. The depending member is located at one end of the container closure and extends down into the container. The result is that the three-dimensional design appears to be suspended within the container.

The depending member either is supported by the upper ledge of the container and held in place by the closure or by being an integral part of the closure. The depending member can have a shaped object attached to a surface or the depending member can be shaped to form the object. The depending member can be of essentially any shape that can be fitted through a container opening. Usually this container opening will be the fill/dispense opening and the container will be a bottle. The depending member preferably is circular to polygonal in shape and is continuous in the cross-sectional dimension. However, the depending member can be discontinuous in cross sectional dimension with a longitudinal slot or other gap. Such a gap will allow a depending member to be compressed to fit it through a container opening and aid in the assembly of the container.

The depending member also may have a dip tube of a pump dispensing unit passing therethrough with the depending member providing a decorative appearance and at least partially concealing the dip tube. As a further option the depending member may comprise the dip tube of a pump dispensing unit and may be comprised of a decorative shaped object or have decorative shaped object attached thereto.

The container preferably will be transparent to translucent and will have a design on a surface, such as a front or rear surface, which coordinates with the three-dimensional design on the depending member. Most preferably the three-dimensional design on the depending member will coordinate with a design on a front and a rear surface of a container to provide a striking three-dimensional effect.

The decorative effect is enhanced when the liquid in the container is substantially transparent. It can have a tint of a color, however, the depending member must be visually perceptible through the front and/or rear surface of the container. In a further preferred embodiment the material of the depending member, and optionally a dip tube, and the liquid product should have refractive indices of within about 0.5, and most preferably about 0.25 of each other. In this way the depending member, and dip tube, where one is present, will substantially disappear in the product except for the three-dimensional design that is attached to or a part of the depending member or dip tube. The three-dimensional design will be of color different from that of the depending member and contained liquid so as to have a different refractive index and be clearly visible.

The result is a novel and enhanced appearance to the container. The container is very decorative and has a unique three-dimensional appearance.

BRIEF SUMMARY OF THE DRAWINGS

The drawings show a preferred embodiment of the invention with other embodiments evident from the drawings.

DETAILED DESCRIPTION OF THE INVENTION

The preferred embodiments of the invention will now be described with reference to the drawings. Various modifications to the described preferred embodiments are directed to the same concept and are considered to be within the present invention.

Figure 1:
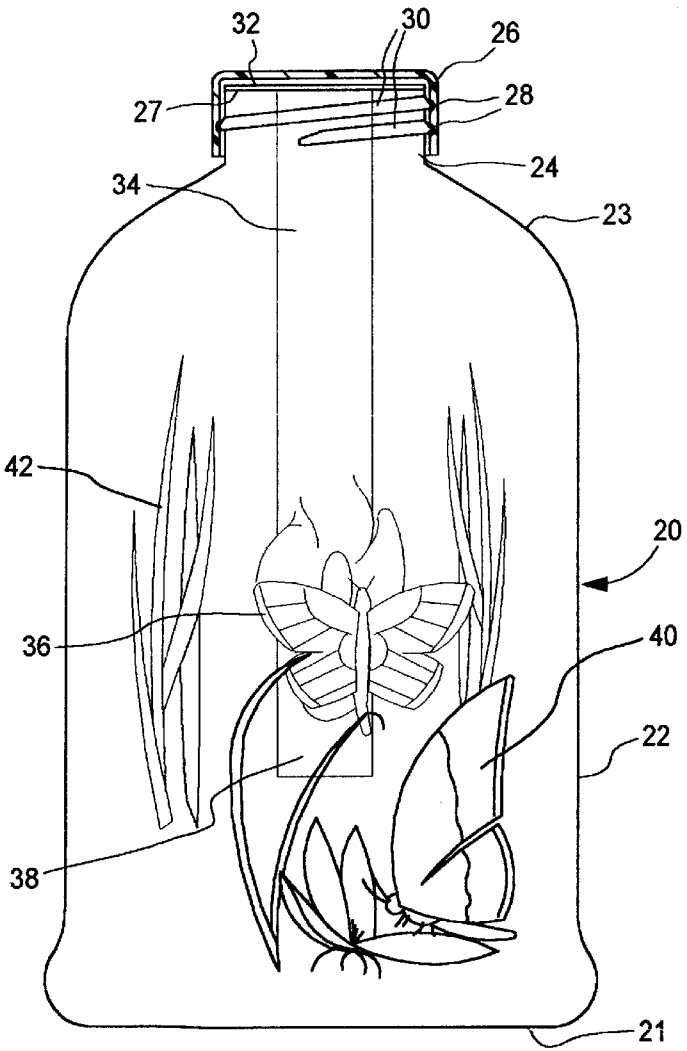
FIG. 1 is a front elevational view of a container having a depending member with an integral three-dimensional design.

In FIG. 1 there is shown container 20 having a base wall 21, sidewall 22, shoulder 23 and neck 24. The neck has threads 30 which mate with threads 28 on closure 26. Extending downward into the container is depending member 34. This depending member has a flange 32 at the upper and that rests on top edge 27 of the neck 24 of the container. In about a mid-area of the support is a three-dimensional design 36. This is shown here as an integrally molded part of the depending member 34. There is a portion 38 of the depending member below the three-dimensional design 36.

Figure 7:
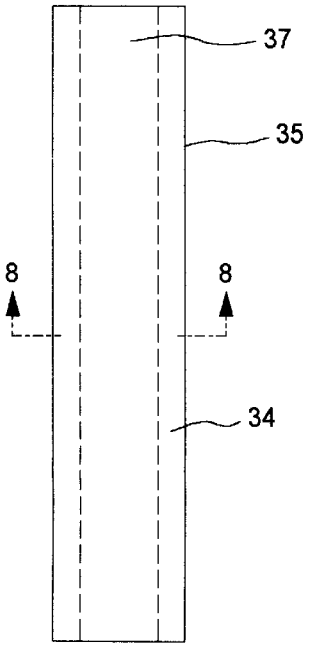
FIG. 7 is an elevation view of a depending member that has a longitudinal slot.
Figure 8:
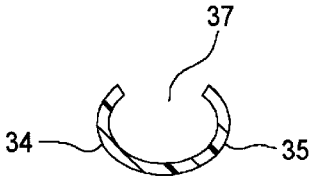
FIG. 8 is a cross-sectional view of the depending member of FIG. 7 along line 8—8.

Depending member 34 can be of essentially any shape. It can be a cylindrical tube having one or more sides. It can be continuous or can be discontinuous in cross-section as is shown in FIGS. 7 and 8. In these latter Figures the depending member 34 is generally U-shaped with a gap 37. Such a gap is advantageous in that the depending member can be folded over onto itself so that it can be more easily be inserted through the neck of a container. Further the U-shape can be so truncated so as to be rod-like in shape.

There is shown on the front surface of the container a design 40 and on the rear surface a design 42. At least one of these designs, and preferably both designs, coordinate visually with the three-dimensional design 36 on the depending member 34. The visual coordination of the label designs with the design on the three-dimensional design on the depending member produces a dramatic appearance to the container 20.

The depending member can have the integral three-dimensional design formed onto the depending member in various ways. Preferred technologies are injection molding and blow molding.

Figure 2:
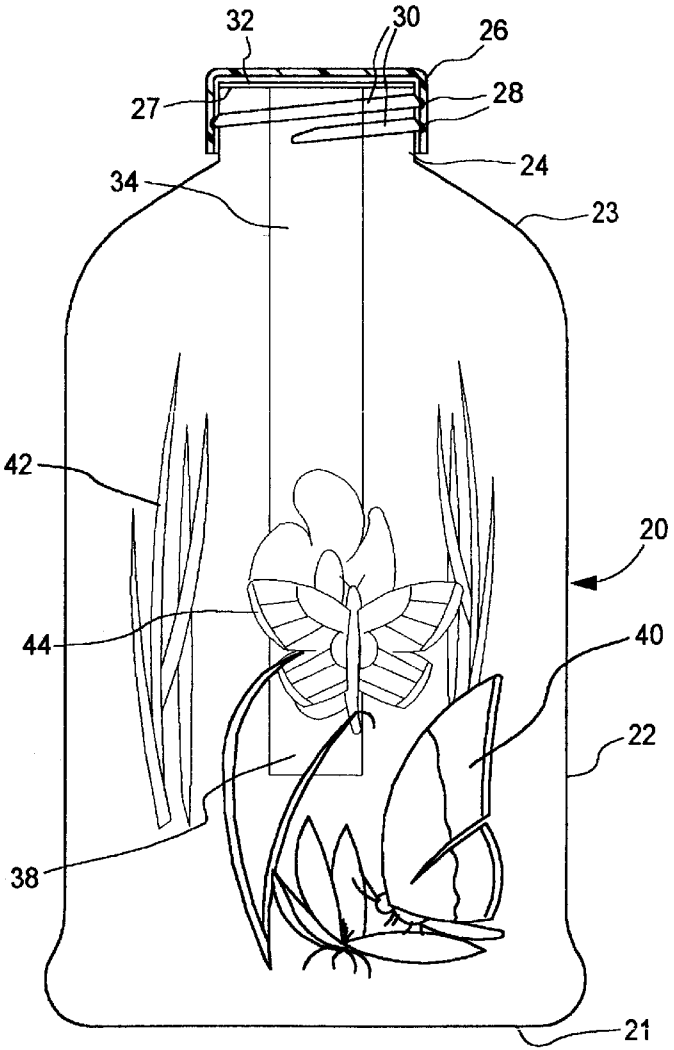
FIG. 2 is a front elevational of a container having a depending member with an attached three-dimensional design.

FIG. 2 shows a variation of the embodiment of FIG. 1. The container, closure and depending member are the same, except in place of the three-dimensional design being an integral part of the depending member 34, here the three-dimensional design 44 is mechanically and/or adhesively attached to the depending member. The three-dimensional design is attached mechanically to the depending member by at least partially enveloping the depending member , having projections that fit into recesses of the depending member, or by the use of straps or equivalent devices on the three-dimensional design to attach it to the depending member. This three-dimensional design will coordinate visually with a design 40 on the front surface of the container, and preferably also with the design 42 on the rear surface of the container.

Figure 3:
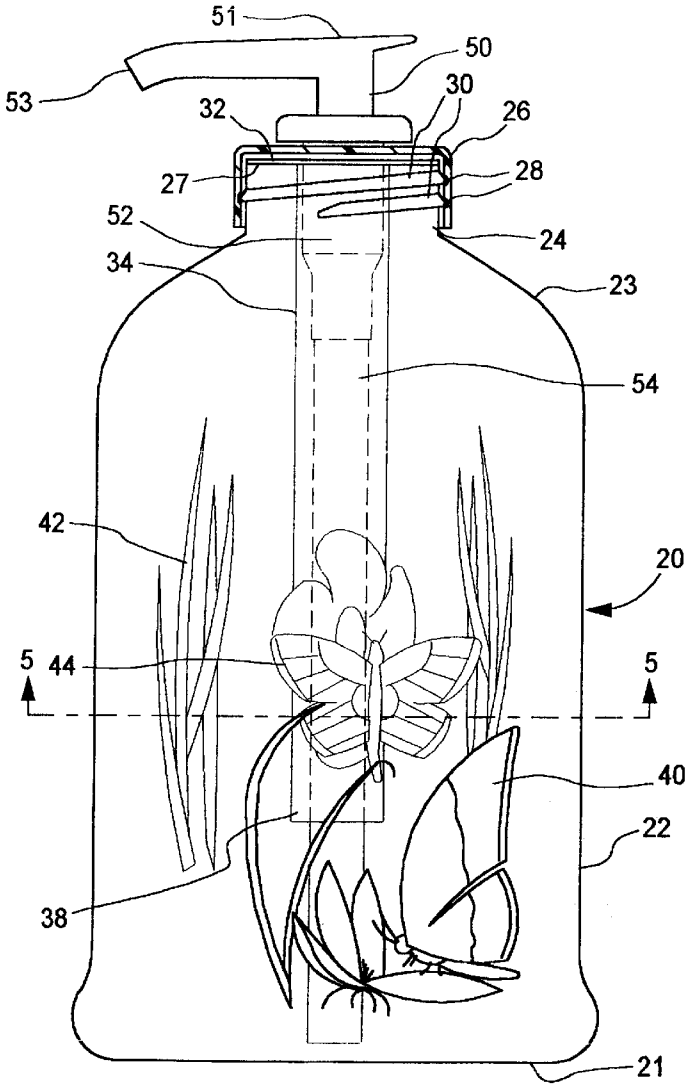
FIG. 3 is a front elevational view of the container of FIG. 2 including a pump with a dip tube.

FIG. 3 is a modification of the embodiment of FIG. 2 in that it incorporates a pump dispenser. The closure 26 has a built in pump dispenser 50 which has an upper pump lever 51 and a pump exit 53. The pump engine 52 is located within the closure 26 and has a depending dip tube 54. The pump engine contains the valving necessary for the operation of the pump. This depending dip tube passes longitudinally through depending member 34. Here as in the embodiment of FIG. 3 there is a design 40 and/or a design 42 on the front and rear surfaces of the container respectively which coordinates with the design of three-dimensional design 44 on depending member 34.

Figure 4:
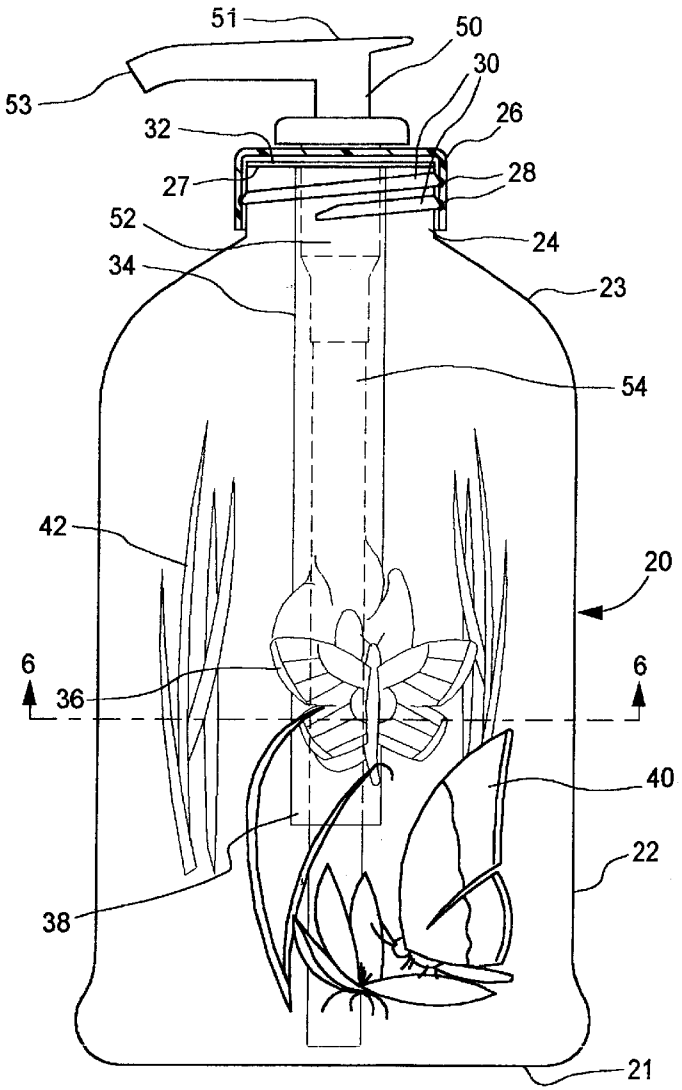
FIG. 4 is a front elevational view of the container of FIG. 1 with a dip tube.

FIG. 4 is a modification of the container of FIG. 1. The modification is the addition of pump dispenser 50 as a part of closure 26. This pump has pump activating lever 51, dispensing exit 53 and pump engine 52. Depending from pump engine 52 is dip tube 54. This embodiment is similar to that of FIG. 1 except that it contains a dispensing pump. Depending member 34 surrounds the dip tube 54 and has three-dimensional design 36 which coordinates with the design 40 and/or 42 on the container.

Figure 5:
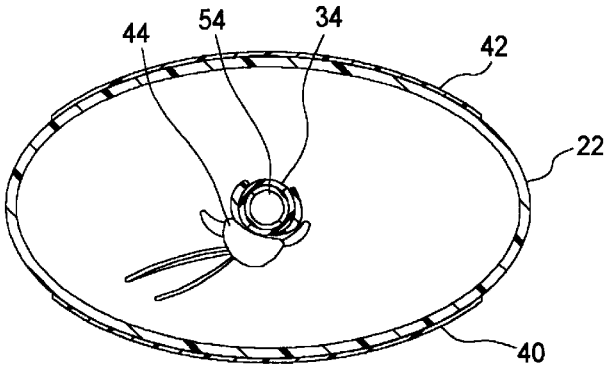
FIG. 5 is a cross-sectional view of the container of FIG. 3 along line 5—5.

FIG. 5 is a cross-sectional view of the pump dispenser of FIG. 3 along lines 5—5. There is shown here the container wall 22 with a design 40 on the front surface and a design 42 on the rear surface. Within the container is dip tube 54 and depending member 34 with three-dimensional design 44 attached to the depending member. Preferably design 40, three-dimensional design 44 and design 42 coordinate in a line of sign arrangement to provide a dramatic visual effect.

Figure 6:
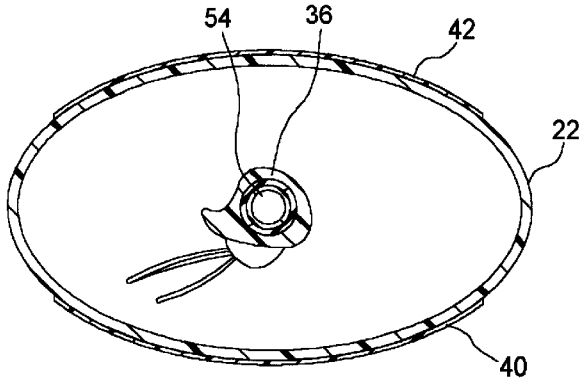
FIG. 6 is a cross-sectional view of the container of FIG. 4 along line 6—6.

FIG. 6 is a cross-sectional view of the container of FIG. 4 along line 6—6. There is shown container wall 22 with a design 40 on the front surface and a design 42 on the rear surface. Within the container is dip tube 54 surrounded by three-dimensional design 36 which is an integral part of the depending member 34. It is preferred that the designs 40 and 42 coordinate in a visual alignment with the three-dimensional design.

Figure 9:
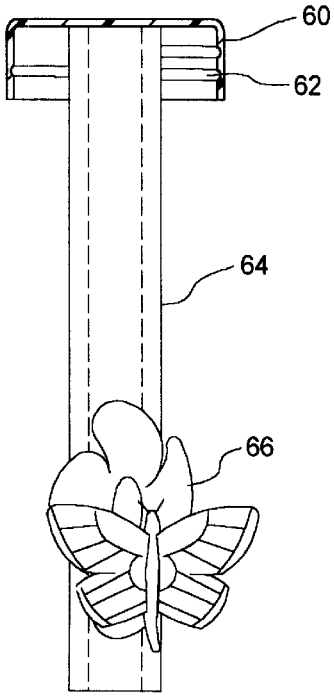
FIG. 9 is an elevational view of a depending member that is a part of the closure.

FIG. 9 shows the depending member being an integral part of the closure 60. Threads 62 attach the closure to the neck of a container. Depending from the closure is depending member 64 which supports three-dimensional design 66. This three-dimensional design likewise will coordinate with a design 40 on the front surface of a container and design 42 on a rear surface of a container. A dip tube also can be accommodated within depending member 64.

Figure 10:
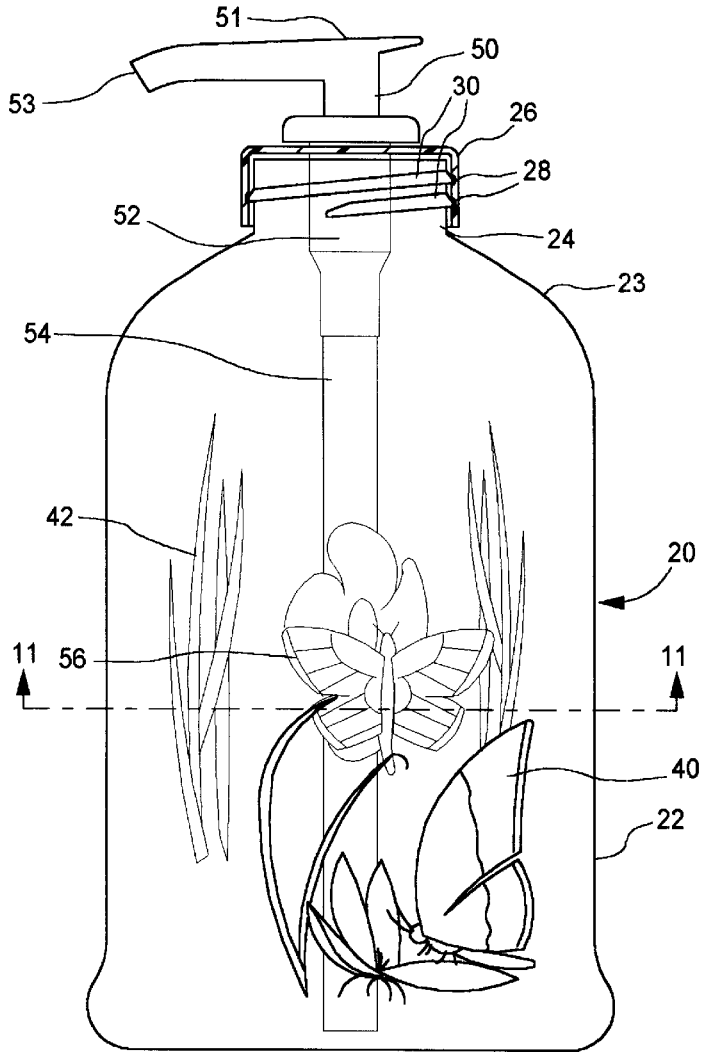
FIG. 10 is an elevational view of a container that has a dip tube with a three-dimensional design and coordinating designs on the front and rear surfaces.
Figure 11:
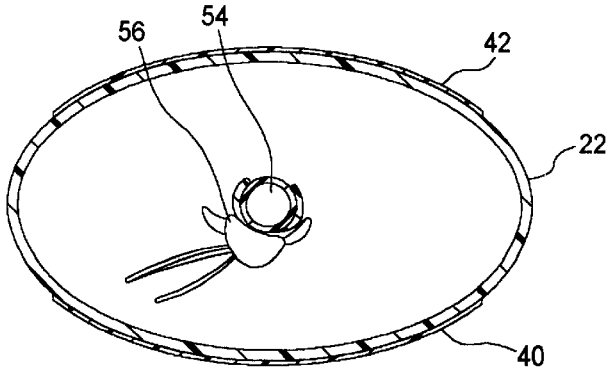
FIG. 11 is a cross-sectional view of the container of FIG. 10 along line 11—11.

FIG. 10 in a further embodiment shows the container of FIG. 3 with the dip tube functioning as the depending member. The three-dimensional FIG. 56 is attached to a dip tube 54. This three-dimensional design will be attached to the dip tube mechanically and/or by means of adhesives. FIG. 11 shows this embodiment in a cross-sectional view.

The container preferably is at least partially transparent, and most preferably fully transparent. Suitable materials for the container are polyethylene terephthalate, polycarbonates, polyvinyl chloride and oriented polypropylenes. The depending member can be the same material as the container or a different material. This likewise is the case for the dip tube in the embodiment where the closure for the container is a pump dispenser. Suitable materials for the depending member and the dip tube include polyethylenes, polypropylenes, polycarbonates, polyethylene terephthalates and polyvinyl chlorides.

The designs on the surfaces of the container can be printed onto the surface of the container such as by screen printing or they can be labels adhesively attached to the container. They can be on the inner or outer surface of the container, but preferably are on the exterior surface of the container. The design on the front surface or the rear surface must visually coordinate with and be complementary to the three-dimensional design in the container. Preferably both the front surface design and the rear surface design coordinate with and are complementary to the three-dimensional design in the container.

As noted, the designs on the front and/or rear surfaces will coordinate with the three-dimensional design in the container. The three-dimensional design can be that of a human, an aquatic, land, air or sea animal, or an object such as a vehicle, airplane, trees, flowers or furniture piece. The design on the front and/or rear surfaces then will coordinate with this three-dimensional design. When the three-dimensional design is an aquatic animal, such as a dolphin, the front design can contain fish and the rear design a blue area to depict water and some additional fish. There are many variations in the three-dimensional design and the designs on the front and/or rear surfaces of the container. The only requirement is that the three-dimensional design be complementary and coordinate with the design on the front and/or rear surfaces of the container. Preferably it will coordinate with a design on both the front and rear surfaces of the container.

In a further preferred mode it is preferred that the material of the depending member and the dip tube have a refractive index of about 0.5, and most preferably about 0.25 of the liquid product in the container. In this way the parts of the depending member and/or dip tube that do not carry the three-dimensional design will substantially visually disappear in the liquid in the container. Usually the three-dimensional design will appear to be suspended within the container. The three-dimensional design preferably will be of a color and refractive index different from that of the product liquid and depending member.

The liquids to be dispensed from the container preferably are substantially transparent. They can have the tint of a color, but to be substantially transparent the three-dimensional design, and preferably also the rear surface design, must be visible through the front of the container. When the liquid has a tint of a color, preferably this coordinates with the design on the front or rear surfaces and the three-dimensional design. For instance, for an aquatic scene the liquid can be tinted blue to depict water. Products with these properties include liquid soaps, shampoos, lotions, oils, beverages and related products.

This describes the preferred embodiments of the inventions. Variations embodying these concepts are considered to be within the present invention.

What is claimed is:

1. A container having a three-dimensional design comprising a container having a front surface and a rear surface, and a neck having an opening at an upper end thereof, at least one of said front surface and said rear surface having a design thereon, a depending member supported solely by an upper ledge on said neck and held in place by a closure on said neck and having a three-dimensional design thereon, said three-dimensional design on said depending member coordinating with a design on one of said front surface and said rear surface.

2. A container as in claim 1 wherein said depending member is supported on an upper edge of said neck, a closure on said container contacting said depending member to hold a portion of said depending member between said upper edge of said neck and said closure.

3. A container as in claim 1 wherein said three-dimensional design on said depending member is an integral part of said depending member.

4. A container as in claim 1 wherein said three-dimensional design on said depending member is attached to an exterior surface of said depending member.

5. A container as in claim 4 wherein said three-dimensional design is adhesively attached to said depending member.

6. A container as in claim 1 wherein said depending member has a longitudinal slot along a substantial portion of the length thereof.

7. A container as in claim 6 wherein said longitudinal slot extends the length of said depending member.

8. A container as in claim 1 wherein said depending member comprises an upper portion supported by said neck, a rod extending downward from said neck, said rod supporting said three-dimensional design.

9. A container as in claim 1 wherein said container has a liquid therein, said liquid and said depending member except for said three-dimensional design thereon having a refractive index within about 0.5 of the other whereby said depending member except for said three-dimensional design substantially disappears in said liquid providing the appearance of said three-dimensional design suspended in said liquid.

10. A container as in claim 9 wherein said liquid and said depending member have a refractive index within about 0.25 of the other.

11. A container as in claim 9 wherein said container has a pump closure with a dip tube extending down into said container, said dip tube having a refractive index of about 0.5 of said liquid.

12. A container as in claim 1 wherein said dip tube and said liquid have a refractive index of about 0.25 of the other.

13. A container as in claim 1 wherein said container has a liquid therein, said liquid has a tint of a color to coordinate with the design on one of said front and rear surface and with said three-dimensional design.

14. A container as in claim 1 wherein the neck of said container is closed with a pump closure, a dip tube depending from said pump closure, said depending member substantially surrounding said dip tube.

15. A container as in claim 14 wherein said depending member is supported on an upper edge of said neck, a closure on said container contacting said depending member to hold a portion of said depending member between said upper edge of said neck and said closure.

16. A container as in claim 14 wherein said depending member has a longitudinal gap along a substantial portion of the length thereof.

17. A container as in claim 14 wherein said longitudinal gap extends the length of said depending member.

18. A container as in claim 14 wherein said container has a liquid therein, said liquid and said depending member except for said three-dimensional design thereon having a refractive index within about 0.5 of the other whereby said depending member except for said three-dimensional design substantially disappears in said liquid providing the appearance of said three-dimensional design suspended in said liquid.

19. A container as in claim 18 wherein said liquid and said depending member have a refractive index within about 0.25 of the other.

20. A container as in claim 19 wherein said dip tube has a refractive index of about 0.5 of said liquid.

21. A container as in claim 20 wherein dip tube and said liquid have a refractive index of about 0.25 of the other.

22. A container as in claim 20 wherein said container has a liquid therein, said liquid has a tint of a color to coordinate with the design on one of said front and rear surface and with said three-dimensional design.

23. A container as in claim 1 wherein said container is closed by a pump closure, said pump closure having a dip tube, said dip tube comprising said depending member.

24. A container as in claim 23 wherein said three-dimensional design on said depending member is an integral part of said depending member.

25. A container as in claim 23 wherein said three-dimensional design on said depending member is attached to an exterior surface of said depending member.

26. A container as in claim 23 wherein said three-dimensional design is adhesively attached to said depending member.

27. A container as in claim 23 wherein said container has a liquid therein, said liquid and said dip tube except for said three-dimensional design thereon having a refractive index within about 0.5 of the other whereby said depending member except for said three-dimensional design substantially disappears in said liquid providing the appearance of said three-dimensional design suspended in said liquid.

28. A container as in claim 27 wherein said liquid and said dip tube have a refractive index within about 0.25 of the other.

29. A container as in claim 23 wherein said container has a liquid therein, said liquid has a tint of a color to coordinate with the design on one of said front and rear surface and with said three-dimensional design.

30. A method of assembling a container containing a three-dimensional design comprising:

providing a container having a rear surface, a front surface and a neck having an opening at an upper end thereof;

providing a depending member having a three-dimensional design thereon, said depending member having a flange on an upper part thereof;

inserting said depending member into said container, said flange supported on an upper ledge of said neck; and attaching a closure to said ledge of said container, said depending member being held between said ledge of said neck of said container and said closure.

31. A method as in claim 30 wherein a design is applied to at least one of a front surface and a rear surface of said container, said design being chosen to coordinate with said three-dimensional design.

32. A method as in claim 30 wherein said closure is a pump with a dip tube, said dip tube being located within said depending member.

33. A container having a three dimensional design comprising a container having a front surface and a rear surface, and a neck having an opening at an upper end thereof, at least one of said front surface and said rear surface having a design thereon, a closure closing an upper end of said neck, a depending member depending from said closure and having a three dimensional design thereon, said three dimensional design on said depending member coordinating with a design on one of said front surface and said rear surface.

34. A container as in claim 33 wherein said depending member is an integral part of said closure.

* * * * *